US006866895B2

(12) United States Patent
Baker et al.

(10) Patent No.: US 6,866,895 B2
(45) Date of Patent: Mar. 15, 2005

(54) INK JET RECORDING MEDIA AND METHOD FOR THEIR PRODUCTION

(75) Inventors: Julie Baker, Leavesden (GB); Malcolm D. Purbrick, Bushey (GB)

(73) Assignee: Eastman Kodak Company, Rochester, NY (US)

( * ) Notice: Subject to any disclaimer, the term of this patent is extended or adjusted under 35 U.S.C. 154(b) by 91 days.

(21) Appl. No.: 10/289,194

(22) Filed: Nov. 6, 2002

(65) Prior Publication Data

US 2003/0099822 A1 May 29, 2003

(30) Foreign Application Priority Data

Nov. 10, 2001 (GB) ..... 0127046

(51) Int. Cl.[7] ..... B05D 3/02
(52) U.S. Cl. ..... 427/393.5
(58) Field of Search ..... 427/393.5

(56) References Cited

U.S. PATENT DOCUMENTS

| | | | |
|---|---|---|---|
| 5,326,391 | A | 7/1994 | Anderson et al. |
| 5,605,750 | A | 2/1997 | Romano et al. |
| 2001/0023014 | A1 | 9/2001 | Patel et al. |

FOREIGN PATENT DOCUMENTS

| | | | |
|---|---|---|---|
| EP | 1072430 A2 | | 1/2001 |
| JP | 2001 - 115620 | * | 6/2001 |
| WO | WO 01 / 53107 | * | 7/2001 |
| WO | WO 01 / 89824 | * | 11/2001 |

OTHER PUBLICATIONS

Salsman, Paper Age, 114(7), pp 18–19, Jul. 1998.*

* cited by examiner

*Primary Examiner*—Erma Cameron
(74) *Attorney, Agent, or Firm*—Harold E. Cole; Chris P. Konkol

(57) ABSTRACT

An image recording medium for an ink jet printer comprises (a) a sheet of solvent absorbing microporous material which comprises a matrix of substantially water insoluble thermoplastic organic polymer, finely divided substantially water insoluble filler particles of which at least 50% by weight are siliceous particles said filler particles being distributed throughout the matrix and constituting from 40 to 90% by weight of said micorporous material, there being a network of interconnecting pores communicating substantially throughout said microporous material said pores constituting from 35 to 95% by volume of said microporous material, said sheet of microporous material having (b) a coating of a polyester. The polyester can be a condensation product obtained from dicarboxylic acids and glycols and contains sufficient hydrophilic groups such as sulphonate to make it water dispersible. The ink jet recording medium can be made by coating a sheet of the microporous material with an aqueous dispersion of a polyester resin and allowing the coated sheet to dry.

8 Claims, No Drawings

INK JET RECORDING MEDIA AND METHOD FOR THEIR PRODUCTION

FIELD OF THE INVENTION

This invention relates to ink jet recording media and to a method for their production.

BACKGROUND OF THE INVENTION

In a typical ink-jet recording or printing system, ink droplets are ejected from a nozzle at high speed towards a recording medium to produce an image on the medium. The ink droplets, or recording liquid, generally comprise a recording agent such as a dye, and a large amount of solvent to prevent clogging of the nozzle. The solvent or carrier fluid, typically is made up of water, an organic material such as a monohydric alcohol or a polyhydric alcohol.

The recording medium typically comprises a substrate or a support material having on at least one surface an ink receiving or image forming layer. The media include those intended for reflection viewing which usually have an opaque support and those intended for viewing by transmitted light which usually have a transparent support.

While a wide variety of different types of image recording media have been previously described there are many unsolved problems in the art and many deficiencies in the known products which have severely limited their commercial usefulness. The requirements for an image recording medium are very demanding. For example the recording medium must be capable of absorbing or receiving large amounts of ink applied to the image forming surface as rapidly as possible in order to produce recorded images having high optical density and good colour gaumet.

PROBLEM TO BE SOLVED BY THE INVENTION

One example of an opaque image-recording element is described in U.S. Pat. No. 5,326,391. It consists of a layer of a microporous material which comprises a matrix consisting essentially of a substantially water insoluble thermoplastic organic polymer such as a linear ultra high molecular weight polyethylene, a large proportion of finely divided water insoluble filler of which at least about 50% by weight is siliceous and interconnecting pores. The porous nature of the image-recording medium disclosed in U.S. Pat. No. 5,326,391 allows inks to penetrate the surface of the medium to produce text and graphic images. However the images produced on these media have been found to be of poor quality ie the images have low optical density and poor colour gamut. Thus it can be seen that a need still exists for the provision of an opaque image recording medium suitable for use in an ink jet printer which is capable of recording images, including coloured images, having high optical densities and good colour gamut.

U.S. Pat. No. 5,605,750 describes a solution to this problem in which an upper image-forming layer of porous pseudo-boehmite having an average pore radius of from 10 to 80 Angstrom units is applied as a coating over the water insoluble thermoplastic organic polymer.

The present invention provides an alternative solution in which an aqueous dispersion of a polyester resin is applied to the water insoluble thermoplastic organic polymer to form a coating thereon.

SUMMARY OF THE INVENTION

According to the present invention there is provided an image recording medium for an ink jet printer which comprises:

(a) a sheet of solvent absorbing microporous material which comprises a matrix of substantially water insoluble thermoplastic organic polymer and finely divided substantially water insoluble filler particles said sheet of microporous material having (b) a coating of a polyester wherein the amount of polyester is selected so that images obtained from the recording medium have improved gloss and colour density as compared with images obtained from the uncoated microporous material.

ADVANTAGEOUS EFFECT OF THE INVENTION

By the selection of appropriate amounts of water dispersible polyester and, where blends of different polyesters are used by adjustment of the proportions of the polysters, the invention provides inkjet recording media which produce images having improved gloss and colour density as compared with images obtained with the uncoated microporous material and although drying time is increased it is well within acceptable limits.

DETAILED DESCRIPTION OF THE INVENTION

Conveniently at least 50% by weight of the filler particles are siliceous particles and are distributed throughout the matrix and constitute from 40 to 90% by weight of said micorporous material, there being a network of interconnecting pores communicating substantially throughout said microporous material said pores constituting from 35 to 95% by volume of said microporous material.

Generally the recording media of the present invention do not require a substrate or support in addition to the microporous material although a support layer may be used if desired. Recording media which comprise only a sheet of microporous material and a coating of water dispersible polyester are therefore within the scope of the present invention.

The recording medium of the present invention generally comprises a sheet of microporous material coated on at least a portion of at least one surface with a water dispersible polyester resin.

Examples of microporous materials suitable for use in the present invention are described in the following U.S. Pat. Nos. 2,772,322; 3,351,495; 3,696,061; 3,725,520; 3,862,030; 3,903,234; 3,967,978; 4,024,323; 4,102,746; 4,169,014; 4,210,709; 4,226,926; 4,237,083; 4,335,193; 4,350,655; 4,472,328; 4,585,604; 4,613,643; 4,691,750; 4,791,144; 4,833,172; 4,861,644; 4,892,779; 4,927,802; 4,872,779; 4,937,115; 4,957,787; 4,959,208; 5,032,450; 5,035,886; 5,071,645; 5,047,283 and 5,114,438.

The matrix of the microporous material comprises a water-insoluble thermoplastic organic polymer. In general, any substantially water-insoluble thermoplastic organic polymer which can be extruded calandared, pressed, or rolled into sheet film strip or web may be used.

The polymer may be a single polymer or a mixture of polymers. The polymers may be homopolymers, copolymers, random copolymers, block copolymers, graft copolymers atactic polymers, isotactic polymers, syndiotactic polymers linear polymers or branched polymers.

Preferably the polymer comprises essentially linear ultrahigh molecular weight polyolefin selected from essentially linear ultrahigh molecular weight polyethylene having an intrinsic viscosity of at least 10 deciliter/gram, essentially linear ultrahigh molecular weight polypropylene having an intrinsic viscosity of at least 6 deciliters/gram and mixtures thereof.

Many of the microporous materials useful in the recording media of the present invention are commercially available.

One example is a polyethylene polymer containing material sold by PPG Industries Inc Pittsburgh Pa under the trade name of Teslin™ which is a synthetic printing sheet in the form of a single layer highly filled microporous film. It is composed of very high molecular weight high density polyethylene which contains approximately 60% by weight of non-abrasive, amorphous precipitated silica and 45 to 60 volume % of air.

According to a preferred embodiment of the present invention there is provided an inkjet recording medium comprising a microporous material as hereinbefore defined having thereon a coating prepared from a water dispersible polyester resin said ink jet recording medium having:

(i) a dry time of less than 2 minutes preferably less than 90 seconds and (ii) an average gloss at 60 degrees angle of at least 5.0, preferably at least 7.5, more preferably at least 20.0 and (iii) an average colour density of at least 0.7, preferably at least 0.8, more preferably at least 1.1.

The corresponding figures for uncoated Teslin™ are dry time: zero, average gloss 2.3 and average colour density 0.52.

Suitable polyester resins are condensation products obtained from dicarboxylic acids and glycols made water dispersible by the introduction of a sufficient number of sulphonate ($SO_3$) groups or the like. Typical molecular weights are in the range from about 5,000 to 30,000 preferably from about 10,000 to about 15,000.

Particularly suitable polymers are those sold under the trade mark Eastek by the Eastman Chemical Company.

According to another aspect of the present invention a method for the preparation of an image recording medium for use in inkjet printing comprises coating a sheet of a microporous material as hereinbefore defined with an aqueous dispersion of a polyester resin and allowing the coated sheet to dry.

Preferred laydowns of polyester are in the range from 1 to about 10 g/m$^2$.

According to one embodiment of the invention a method for the production of an image recording medium for use in ink jet printing comprises coating a sheet of microporous material as hereinbefore defined with an aqueous dispersion of a polyester and allowing the coating to dry and which comprises controlling the amount of polyester laid down, and where more than one polyester is used, by adjusting their proportions, to obtain an image recording medium which gives images having improved gloss and colour density as compared with images obtained from the uncoated microporous material.

The invention is illustrated by the following Examples.

A Teslin (Registered Trade Mark) support was coated with two aqueous dispersions of polyester resins each containing 30% by weight of polymer solids. The dispersions were applied using a K 303 hand coater from R K Print-Coat Instruments Ltd. Different bars were used to prepare different laydowns of the polyester resin dispersions and then allowed to dry at ambient temperature.

Teslin ™ is a high molecular weight high density polyethylene containing approximately 60% by weight of non-abrasive, amorphous precipitated silica. The laydown of the polyester resins ranged from 1.8 g/m to 7.2 g/m Combinations were identified which gave good dry times, improved density and gloss compared with uncoated Teslin ™.

Dry time was evaluated by a piece of paper sandwiched to a printed image immediately after it exits the printer and then peeled apart. The piece of paper is the n visually assessed and the point at which the ink transfer disappears can be identified. Knowing the time taken for the image to print, the average time taken for the sample to dry can then be calculated.

TABLE 1

Effect of aqueous polyester resin dispersion laydown on dry time.

| Coating number | Eastek ® g/m$^2$ 1100 g/m$^2$ | Eastek ® 1300 g/m$^2$ | Total laydown | Average dry time mins |
|---|---|---|---|---|
| Uncoated Teslin ® | | | | 0.00 |
| 7 | 0.9 | 0.9 | 1.8 | 0.15 |
| 8 | 1.8 | 1.8 | 3.6 | 0.79 |
| 9 | 3.6 | 3.6 | 7.2 | 0.98 |
| Time taken to print image (mins) | | | | 4.37 |

Eastek 1100 and 1300 are both made by a condensation reaction involving isophthalic acid (IPA), 5-(sodiosulfo) isophthalic acid (SSIPA), ethylene glycol (EG), diethylene glycol (DEG), and 1,4-cyclohexanedimethanol (CHDM). Eastek 1100 contains 9 mole % of SSIPA and 23 mole % CHDM. The remainder is IPA and DEG.

Eastek 1300 contains 5.5 mole % SSIPA, zero CHDM, 15 mole % EG and 35 mole % DEG, the remainder being IPA.

TABLE 2 bThe effect of aqueous polyester resin dispersion laydown on colour density.

| No | Eastek ® 1100 g/m$^2$ | Eastek ® 1300 g/m$^2$ | Total laydown g/m$^2$ | black | cyan | magenta | yellow | red | green | blue |
|---|---|---|---|---|---|---|---|---|---|---|
| Uncoated Teslin ® | | | | 1.11 | 0.65 | 0.37 | 0.06 | 0.33 | 0.47 | 0.63 |
| 7 | 0.9 | 0.9 | 1.8 | 2.05 | 1.20 | 0.49 | 0.09 | 0.45 | 1.04 | 1.30 |
| 8 | 1.8 | 1.8 | 3.6 | 2.31 | 1.32 | 0.63 | 0.10 | 0.60 | 1.15 | 1.60 |
| 9 | 3.6 | 3.6 | 7.2 | 2.31 | 1.40 | 0.73 | 0.09 | 0.70 | 1.28 | 1.89 |

The density was determined by taking a printed sample and measuring the density of each of the coloured steps on an X-rite densitometer.

The effect on gloss of different polymer laydowns of Eastek 1100 and 1300 polesters was measured and the results are recorded in Table 3.

TABLE 3

The effect of aqueous polymer dispersion laydown on gloss.

| Ctg No | Eastek ® 1100 g/m² | Eastek ® 1300 g/m² | % Gloss @60° angle Coating | black | cyan | magenta | yellow | red | green | blue | Average Gloss | Std Dev Gloss |
|---|---|---|---|---|---|---|---|---|---|---|---|---|
| Uncoated Teslin | — | — | 3.3 | 2.3 | 2.4 | 1.9 | 1.4 | 2.1 | 2.1 | 3.0 | 2.3 | 0.60 |
| 7 | 0.9 | 0.9 | 8.0 | 7.8 | 8.8 | 7.9 | 21.2 | 8.6 | 8.0 | 10.0 | 10.0 | 4.57 |
| 8 | 1.8 | 1.8 | 13.8 | 13.4 | 15.0 | 12.8 | 34.6 | 14.2 | 12.0 | 16.0 | 16.5 | 7.43 |
| 9 | 3.6 | 3.6 | 17.6 | 20.2 | 21.7 | 19.6 | 47.5 | 20.6 | 18.4 | 20.6 | 23.3 | 9.87 |

The gloss was measured using a sheen microglass meter at an angle of 60 degrees to the coating. Three measurements were taken for each colour and averaged. The average of these is the average in the final column.

The results show a significant improvement in gloss as compared with the uncoated Teslin™.

The printer set up was:

Epson Stylus Photo 700 printer was used with the following settings

Print quality: superfine 1440 dpi

Photo quality ink jet paper

The data show that coating a mixture of the two polyester resin dispersions onto the Teslin™ support results in far superior colour densities and therefore more vibrant colours compared to uncoated Teslin™. As the total laydown of the dispersions is increased, so the densities improve and this is accompanied by a significant increase in gloss. This does however lead to longer dry times as the pores in the support become blocked, although even at the highest laydowns the average dry time was still less than 1 minute.

By adjusting the total laydown of the aqueous polyester resin dispersions a printed image with superior density and gloss can be achieved which also has a very fast dry time

What is claimed is:

1. A method for the preparation of an image recording medium for ink jet printing, said image recording medium comprising a sheet of microporous material which comprises a matrix of substantially water insoluble thermoplastic organic polymer and finely divided substantially water insoluble filler particles, said sheet of microporous material having a polyester coating, which method comprises coating a sheet of the microporous material with an aqueous dispersion of one or more polyester resin and allowing the coated sheet to dry, wherein the image recording medium has a dry time of less than 2 minutes and an average gloss at an angle of 60 degrees of at least 5.0 and an average colour density of at least 0.7.

2. A method as claimed in claim 1 wherein the laydown of the one or more polyester resin is in the range from about 1 to about 10 g/m².

3. A method for the preparation of an image recording medium as claimed in claim 1, wherein by controlling the amount of polyester laid down, and where more than one polyester is used, by adjusting their proportions, an image recording medium is obtained which gives images having improved gloss and colour density as compared with images obtained from the uncoated microporous material.

4. A method as claimed in claim 1, wherein the one or more polyester is a condensation product obtained from dicarboxylic acids and glycols and contains sufficient hydrophilic groups to make it water dispersible.

5. A method as claimed in claim 4, wherein the hydrohphilic groups are sulphonate groups.

6. A method as claimed in claim 1, wherein the one or more polyester resins have a molecular weight in the range from 10,000 to 15,000.

7. A method as claimed in claim 1, wherein at least 50% by weight of the filler particles are siliceous particles being distributed throughout the matrix and constituting from 40 to 90% by weight of said micorporous material, there being a network of interconnecting pores communicating substantially throughout said microporous material said pores constituting from 35 to 95% by volume of said microporous material.

8. A method as claimed in claim 1, wherein the image recording medium has a dry time of less than 90 seconds and an average gloss at an angle of 60 degrees of at least 7.5 and an average colour density of at least 0.8.

* * * * *